United States Patent [19]

Paquette

[11] 4,390,007

[45] Jun. 28, 1983

[54] FUEL PREHEATER

[76] Inventor: Gerard A. Paquette, 195 Pool St., Biddeford, Me. 04005

[21] Appl. No.: 164,887

[22] Filed: Jun. 30, 1980

[51] Int. Cl.[3] ..... F24H 1/00

[52] U.S. Cl. ..... 126/350 R; 431/207; 122/23

[58] Field of Search ..... 126/350 A, 350 R; 431/207; 237/8 R; 123/557; 122/23; 165/163

[56] References Cited

U.S. PATENT DOCUMENTS

| | | | |
|---|---|---|---|
| 971,142 | 9/1910 | Rademacher | 431/207 |
| 1,094,078 | 4/1914 | Lovekin | 431/207 |
| 1,577,428 | 3/1926 | Staples | 431/207 |
| 1,752,548 | 4/1930 | Baird | 126/378 |
| 1,761,975 | 6/1930 | Baird | 126/378 |

*Primary Examiner*—Samuel Scott
*Assistant Examiner*—Randall L. Green
*Attorney, Agent, or Firm*—William Nitkin

[57] ABSTRACT

Apparatus and method for the preheating of oil before combustion in an oil burner utilizing a cannister containing a coil adapted for oil to circulate therethrough which cannister being further adapted for hot water of the heating system to circulate therethrough in order to heat the oil in the cannister.

1 Claim, 2 Drawing Figures

FUEL PREHEATER

BACKGROUND OF THE INVENTION

1. Field of the Invention

The apparatus of this invention resides in the area of oil heating systems and more particularly relates to a system of preheating oil before it is burned within the heating system.

2. History of the Prior Art

In heating systems it has been found desirable to preheat the fuel before it is burned as it helps improve the efficiency and cleanliness of the burning process. It has also been found that by preheating the oil before it enters the system, the viscosity and other properties of the oil are affected so that the burner utilizes less oil to provide the same amount of heat energy.

SUMMARY OF THE INVENTION

It is an object of this invention to provide a simple effective system for preheating oil without utilizing any outside sources of power, which system will be self-contained within the heating system and which is effectively free of the need for supervision and does not require complicated controls in the operation thereof.

The basic element of this fuel preheater is a cannister which contains a coil through which the oil from the oil tank is circulated and from which the oil is then fed to the burner in the normal fashion. Within the cannister hot water from the hot water system of the burner is circulated within the cannister, which water surrounds the coil and increases the temperature of the oil in the range of approximately 180 degrees F. before the oil is fed into the oil burner. A system of recycling keeps the oil at this temperature during periods when the burner is not in use and which is described in further detail below.

DESCRIPTION OF THE PREFERRED EMBODIMENT(S)

Figure 1:
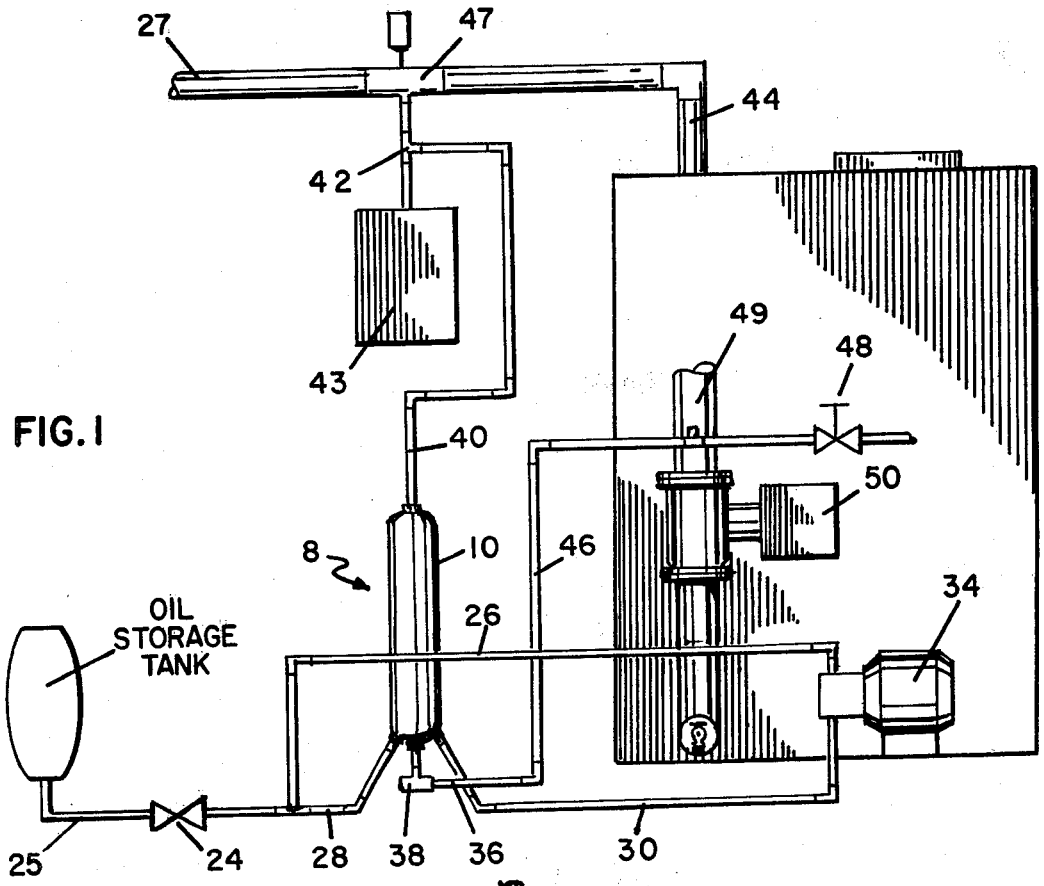
FIG. 1 illustrates a schematic view of the fuel preheater of this invention in use in conjunction with an oil heating system.
Figure 2:
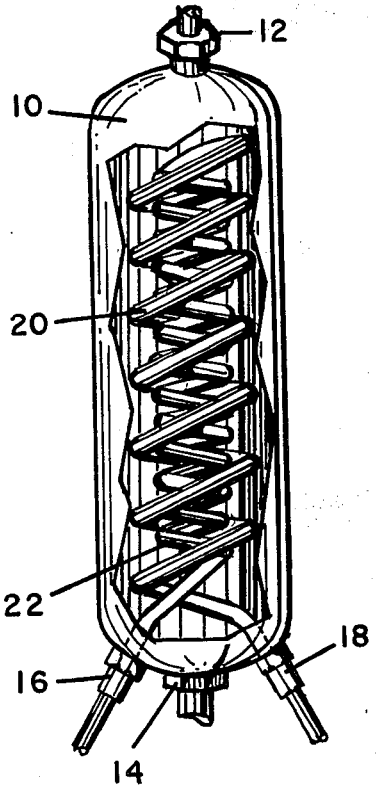
FIG. 2 shows a perspective cutaway view of the fuel preheater of this invention.

FIG. 1 illustrates a typical system of this invention including fuel preheater 8 which is also seen in further detail in FIG. 2. The fuel preheater has a watertight cannister 10 with water inlet 12 at the top thereof and water outlet 14 at the base thereof. The cannister is adapted for hot water to enter through water inlet 12, to circulate through the interior of cannister 10 and to exit through outlet 14. Oil inlet 16 is provided for the oil to pass into inner coil 22 and through outer coil 20 which inner coil and outer coil in a preferred embodiment are approximately 15 feet in total length and to exit through oil outlet 18. The coil may be constructed of copper tubing or any equivalent heat transferring material. It has been found that the oil must circulate through a pipe of sufficient length within the hot water in the cannister in order to raise its temperature. Therefore in order to keep the cannister of a reasonably small size, for example a 20 inch high cannister, the tube must be coiled forming both an inner coil and surrounding that, an outer coil. The oil coming from the oil tank in pipe 25 as seen in FIG. 1 passes first through check valve 24 which prevents any heated oil from going back to the oil tank. The oil then enters through a tee into the circulating system, goes through pipe 28 into the oil inlet 16, then passes through inner coil 22 and through outer coil 20 where it is heated and exits through oil outlet 18 into oil feed pipe 30 which runs to burner 34. Burner 34 has a two-stage pump so that only a portion of the oil is burned and the remainder runs back through pipe 26 into the tee where it is reentered into the circulation system. As long as the pump is operating, the oil is circulated from the burner through the tee and then through the coils of the fuel preheater 8. In order for the hot water to enter the fuel preheater, a tee 42 is added between the air vent 47 and the expansion tank 43. After the hot water passes through cannister 10 making contact and transferring heat to the coil, it passes out through water outlet 14 and into pipe 36. A drainage plug 38 is provided at this point should cleaning be necessary. Pipe 36 extends to pipe 46 which goes to the return pipe 49 of the burner at the point where the cold water feed 48 enters the system. Cold water feed 48 is usually shut off so that the water will then circulate within the system through circulator 50 and ultimately back up through feed pipe 44 to complete its cycle through fuel preheater 8. It is expected that the temperature of the water from the burner will be in the area of 180–200 degrees F. and that the oil after passing through the fuel preheater 8 will enter the oil burner at a temperature of approximately 140–160 degrees F. It has been found that oil at this higher temperature burns more cleanly and efficiently and that an oil burner with this system installed may have to downrate its fuel nozzle by approximately 30% and cut back on the burner's air intake by upwards of 75%. The burner will run to produce the same amount of heat but at a lower fuel rate than it would without the system of this invention.

Although the present invention has been described with reference to particular embodiments, it will be apparent to those skilled in the art that variations and modifications can be substituted therefor without departing from the principles and spirit of the invention.

I claim:

1. An oil preheater for use in a heating system of the type where the oil before being preheated is stored in a tank and is preheated at a point in the system while being piped to an oil burner which burns said oil in a furnace having a hot water heating system of the type with hot water exiting from said furnace by means of a hot water feed pipe and re-entering said furnace through a return line pipe, said hot water feed pipe having an air vent and expansion tank thereon, and said return line pipe having a cold water feed for entry of additional water into said hot water heating system at times when additional water is needed to replace any water lost from the system, comprising:

a cannister having a water inlet and a water outlet, an oil inlet and an oil outlet;

a double-coiled tube member located within said cannister having a first and second end, said first end being connected to said oil outlet and said second end being connected to said oil inlet;

a hot water entry pipe extending from said hot water feed pipe between said air vent and expansion tank to said water inlet of said cannister;

a hot water drain pipe extending from said water outlet of said cannister to said return line pipe of said hot water heating system;

first pipe means to provide oil from said oil tank into said cannister's oil inlet;

a second pipe means to deliver oil from said cannister's oil outlet to said oil burner;

a two-stage pump interconnected to said second pipe means adapted to pump a portion of said oil to said oil burner;

a check valve on said first pipe means providing oil into said cannister to prevent backflow of oil to said oil tank;

a third pipe means extending from said two-stage pump carrying the portion of said oil not pumped into said oil burner back to said first pipe means between said check valve and said oil inlet of said cannister to be recirculated through said cannister to said second pipe means;

whereby the hot water passes through said hot water heating system and also through said cannister to heat said oil-carrying double-coiled tube member and the oil circulating therein and the oil so heated is carried to said oil burner at a higher temperature than unheated oil with any oil that is not burned in said oil burner being recirculated through said double-coiled tube member to maintain its higher temperature.

* * * * *